US009175244B2

(12) United States Patent
Laudenklos et al.

(10) Patent No.: US 9,175,244 B2
(45) Date of Patent: Nov. 3, 2015

(54) CONCENTRATE FOR PRODUCING A COOLING AND RELEASE AGENT OR A COOLING AND LUBRICATING AGENT AND SUCH COOLING AND RELEASE AGENTS AND COOLING AND LUBRICATING AGENTS

(75) Inventors: Manfred Laudenklos, Schoeneck (DE); Matthias Reihmann, Hemsbach (DE)

(73) Assignee: GELITA AG, Eberbach (DE)

( * ) Notice: Subject to any disclaimer, the term of this patent is extended or adjusted under 35 U.S.C. 154(b) by 863 days.

(21) Appl. No.: 13/383,579

(22) PCT Filed: Jul. 2, 2010

(86) PCT No.: PCT/EP2010/059459

§ 371 (c)(1),
(2), (4) Date: Apr. 25, 2012

(87) PCT Pub. No.: WO2011/006777

PCT Pub. Date: Jan. 20, 2011

(65) Prior Publication Data

US 2012/0202722 A1 Aug. 9, 2012

(30) Foreign Application Priority Data

Jul. 13, 2009 (DE) ..... 10 2009 033 158

(51) Int. Cl.

| | |
|---|---|
| ***C10M 141/06*** | (2006.01) |
| ***C10M 173/02*** | (2006.01) |
| ***C10M 169/00*** | (2006.01) |
| ***C10M 169/04*** | (2006.01) |

(52) U.S. Cl.

CPC ..... *C10M 173/02* (2013.01); *C10M 2201/061* (2013.01); *C10M 2201/062* (2013.01); *C10M 2201/066* (2013.01); *C10M 2201/085* (2013.01); *C10M 2207/022* (2013.01); *C10M 2207/122* (2013.01); *C10M 2207/123* (2013.01); *C10M 2207/124* (2013.01); *C10M 2207/289* (2013.01); *C10M 2209/04* (2013.01); *C10M 2209/104* (2013.01); *C10M 2209/12* (2013.01); *C10M 2217/044* (2013.01); *C10M 2219/042* (2013.01); *C10M 2219/044* (2013.01); *C10N 2210/01* (2013.01); *C10N 2210/02* (2013.01); *C10N 2210/05* (2013.01); *C10N 2210/07* (2013.01); *C10N 2210/08* (2013.01); *C10N 2220/021* (2013.01); *C10N 2240/401* (2013.01); *C10N 2240/58* (2013.01); *C10N 2250/02* (2013.01)

(58) Field of Classification Search

CPC ..... C10M 2201/05; C10M 2201/087; C10M 2201/062; C10M 2207/125

USPC ..... 508/151, 156, 162, 171, 172, 175, 216, 508/220

See application file for complete search history.

(56) References Cited

U.S. PATENT DOCUMENTS

| | | | | |
|---|---|---|---|---|
| 3,823,023 | A | 7/1974 | Duggins et al. | |
| 3,860,434 | A | 1/1975 | Okabe et al. | |
| 4,250,046 | A * | 2/1981 | Przybylinski | 508/530 |
| 4,493,777 | A * | 1/1985 | Snyder et al. | 508/472 |
| 4,765,917 | A | 8/1988 | Otaki et al. | |
| 5,320,157 | A | 6/1994 | Siak et al. | |
| 5,776,866 | A | 7/1998 | Karaki et al. | |
| 2004/0067858 | A1 | 4/2004 | Ohkawa et al. | |
| 2004/0253194 | A1 | 12/2004 | Rioux et al. | |
| 2009/0218066 | A1 | 9/2009 | Stötzel et al. | |
| 2010/0237224 | A1 | 9/2010 | Laudenklos | |

FOREIGN PATENT DOCUMENTS

| | | | |
|---|---|---|---|
| DE | 196 37 168 | A1 | 3/1998 |
| DE | 696 27 774 | T2 | 2/2004 |
| DE | 10 2006 002246 | A1 | 7/2007 |
| GB | 4 06 582 | A | 3/1934 |
| JP | 49-040241 | A | 4/1974 |
| JP | 58-049799 | A | 3/1983 |
| JP | 60-109807 | A | 6/1985 |
| JP | 61-103996 | A | 5/1986 |
| JP | 63-089592 | A | 4/1988 |
| JP | 09-157675 | A | 6/1997 |
| JP | 2003-522734 | A | 7/2003 |
| JP | 2004-123978 | A | 4/2004 |
| JP | 2007-056231 | A | 3/2007 |
| SU | 1 715 835 | A1 | 2/1992 |
| WO | WO2007/028615 | A2 | 3/2007 |

OTHER PUBLICATIONS

Chemical Abstracts Service (CAPLUS) [online], In: STN Dialog. Accession No. 85:146629.

* cited by examiner

*Primary Examiner* — Vishal Vasisth
(74) *Attorney, Agent, or Firm* — Norman B. Thot

(57) ABSTRACT

A concentrate for producing a cooling and release agent for reusable casting dies such as a steel casting die, or a cooling and lubricating agent for machining with an active substance dissolved in water. The concentrate comprises 10 to 50 wt.-% of a protein based on the weight of the concentrate.

27 Claims, No Drawings

CONCENTRATE FOR PRODUCING A COOLING AND RELEASE AGENT OR A COOLING AND LUBRICATING AGENT AND SUCH COOLING AND RELEASE AGENTS AND COOLING AND LUBRICATING AGENTS

CROSS REFERENCE TO PRIOR APPLICATIONS

This application is a 371 of PCT/EP2010/059459, filed Jul. 2, 2010.

This application is a U.S. National Phase application under 35 U.S.C. §371 of International Application No. PCT/EP2010/059459, filed on Jul. 2, 2010 and which claims benefit to German Patent Application No. 10 2009 033 158.1, filed on Jul. 13, 2009. The International Application was published in German on Jan. 20, 2011 as WO 2011/006777 A1 under PCT Article 21(2).

FIELD

The present invention provides a concentrate for producing a cooling and release agent for reusable casting dies, or a cooling and lubricating agent, for example, for machining with an active substance dissolved in water. The present invention also provides cooling and release agent for reusable casting dies and a cooling and lubricating agent, for example, for machining purposes.

BACKGROUND

While the use as a cooling and release agent in reusable casting dies is of particular interest in the context of steel casting dies for die casting purposes or forming tools for hot forming purposes, the use as a cooling and lubricating agent is found in the field of machining, for example, in drilling, milling, grinding, cutting, lathing, sawing or thread cutting of cast iron alloys, steel alloys, nickel base alloys, cobalt base alloys, non-ferrous metals and plastic materials, as well as in the field of cold forming.

Such cooling and release agents or cooling and lubricating agents are known from prior art. They serve to cool used casting dies and machined parts. When used as a release agent, a layer is applied at the same time to improve the demolding of the cast product from the die, whereas when used as a lubricating agent, an additional lubrication of the parts and tools is affected that increases their durability.

For example, when casting work pieces on the basis of aluminum, magnesium and zinc or alloys of these metals in a die cast or a squeeze cast method, water-emulsified polymers, such as waxes, silicones or modified polysiloxanes, are used as cooling/release agent. Prior to their use at the die casting tool, the emulsions delivered as a concentrate are diluted to the working concentration required for obtaining a sufficient effect. Typically, dilutions are used that contain 0.12% by weight to 2.5% by weight of dry substance in the cooling and release agent.

The casting die is supplied, for example, under pressure with an alloy melt of 560-740° C. After the solidification of the melt, the cast part is removed from the casting die that is about 450-580° C. hot, and the die is cooled down to about 120-350° C. by spraying a cooling and release agent thereon, it is cleaned if necessary and is again supplied with a melt. The water contained in the cooling and release agent serves to cool the die as well as to free the die from possible residues which, after demolding, remain on the die due to the cooling and release agent used. The release agent is effective in that, depending on the temperature conditions, the polymers themselves form a release layer by being pyrolytically decomposed as the die is filled with the metal to be cast and by subsequent densification.

The use of the known cooling and release agents yields satisfactory results; however, it has some drawbacks.

For example, the cooling and release agent often settles on portions of the die, such as at the die frame and die parting lines, that are not contacted with the metal to be cast and on contours that are less subjected to high temperatures, since the temperature at these portions is insufficient to pyrolytically decompose the cooling/release agent. Instead, the cooling and release agent dries because of the heat still present and can no longer be completely emulsified in water. With repeated spraying operations, this leads to the build-up of a layer resulting in problems of dimensional accuracy of the cast piece and in sealing problems at the die so that casting quality decreases. Insufficient pyrolytic decomposition of the release agent may also cause accretions in the cavity area, which also compromise the casting quality. Residues may be deposited in the surface of the cast piece, for example, in turbulence zones.

The stability and the disposal of these emulsions are also problematic. Longer times of rest after emulsification often result in an inhomogeneous distribution of the active substance in the emulsion, whereby a wetting of surfaces with these cooling and release agents is non-uniform.

The washed-off residues of the known cooling and release agents must also be supplied to a separate waste water treatment since they are not easily biodegradable. Their gaseous residues, which are formed as a result of pyrolytic decomposition during their application, are also hazardous to humans and the environment.

Residues containing wax or silicon often remain on the surface of the cast piece. These are hard to remove so that an increased cleaning effort is required. The removal of these water repellent residues therefore requires the use of strong acids, bases or other solvents.

With known cooling/lubricating agents for machining purposes, the pressure during the chip removal sometimes leads to the forming of built-up edges at the cutting tool and oftentimes causes a bluish discoloration in the machined region of the work piece. The built-up edges reduce the service life of the cutting tool. When the built-up edges become welded on, they can also deteriorate the work piece quality if, for example, parts of the built-up edge come loose and are pressed into the work piece surface. Cooling/lubricating agents moreover sometimes contain mordants as additives that can damage alloy elements in the work piece alloy. The chips produced in machining often have to be freed from cooling/lubricating agents clinging thereto, using multi-stage complex processes, such as filtering and washing, so that the cooling/lubricating agent can be reused in the cycle. The chips themselves often must be disposed of as hazardous waste, since a recycling thereof is not feasible because of the cooling/lubricating agent clinging thereto.

SUMMARY

An aspect of the present invention is to provide a concentrate of a cooling and release agent, as well as a cooling and lubricating agent, or a cooling and release agent and a cooling and lubricating agent, respectively, which avoid the above-mentioned problems. It is intended, for example, that the provided concentrate be biodegradable, the cycle times in a casting process and in a forming process are reduced and, when used as a cooling and release agent, that residues on the die and on the cast piece are avoided as far as possible. When used as a cooling and lubricating agent, the force required for a forming by machining should be reduced and the cooling performance enhanced. The tendency to form built-up edges should be clearly reduced and the alloy elements of the work piece alloy should not be damaged by possible mordant additives. It is desirable to reduce the percentage of dry substance in the cooling and release agent or the cooling and lubricating agent. It is also desirable to allow the chips produced in machining to be reused simply by melting them, and to pyrolytically decompose the cooling/lubricating agent during the melting of the chips, while giving off an oxygen reducing atmosphere.

In an embodiment, the present invention provides a concentrate for producing a cooling and release agent for reusable casting dies, such as a steel casting die, or a cooling and lubricating agent for machining with an active substance dissolved in water. The concentrate comprises 10 to 50 wt.-% of a protein based on the weight of the concentrate.

DETAILED DESCRIPTION

It has surprisingly been found that a cooling and release agent with proteins, for example, proteins such as gelatin, hydrolysate, casein or the proteins of soy and milk, provides a uniform wetting of the casting die surface when sprayed thereon and, during the spraying, forms a uniform and well adhering release film. With a view to the repeated spraying operations after each respective casting operation, a balanced state is achieved between the newly applied agent and the removal of excess release agent. Compared to known release agents, the decomposition behavior is better, whereby the forming of deposits due to dried excess release agent is significantly reduced both in the cavity area and in the area of the die frame. In the casting process and under the temperature conditions prevailing, the release film is decomposed by pyrolytic decomposition in such a manner that a carbon-rich layer is formed during the casting process, which layer is responsible for the releasing effect. At the same time, a diffusion of aluminum towards the casting die is prevented. The pyrolytic decomposition moreover leads to the creation of a reducing atmosphere, which has positive effects on the quality of the cast pieces because of the reduced formation of oxide. Residues of these release agents can be washed off before and after casting more easily than is possible with conventional wax- or siloxane-based release agents. A continuous build-up of release agent residues in the cooler die areas is thereby prevented in a series of casting operations, which results in an improved dimensional accuracy during casting and provides a reliable opening and closing function of the tool. After having been washed with water and dried thereafter, the cast piece thus manufactured can be painted without any further surface treatment so that time-consuming cleaning steps are avoided. The cycle time is reduced by a significantly improved cooling effect. The agent is suited for the usual application methods such as pressure atomizing or pneumatic atomizing using internal or external mixing nozzles. Due to the increased water content in the cooling and release agent, the surfaces of the tools are wetted better and are cooled more efficiently. In contrast with the known silicon oil- or wax-based agents, the so-called Leidenfrost phenomenon is reduced by the hydrophilic properties of the protein, which translates as a clearly discernible reduction in the vapor volume rising up during the cooling proves.

It has been found for such a cooling and lubricating agent that it is a shearing and pressure resistant system and that uniform and long chips are formed during machining. The tendency to ship breaking has been reduced significantly. Slight canting of the tool at small burrs of the part worked on is largely avoided so that the required cutting force and the heat generation are reduced and the risk of built-up edges forming is lessened. At the same time, the cooling effect is improved and the required effort is reduced by the existing lubrication of the surfaces. The chips produced during the machining are free of disturbing deposits and can be supplied to raw material recycling by simply melting them. The cooling/lubricating agent also acts as a corrosion protection.

In an embodiment of the present invention, the protein used can, for example, have a molecular weight between 1000 and 600000 Dalton and a nitrogen content of 16-19%, the hydroxyproline content being, for example, 10 to 15%. With these proteins, good results have been achieved with respect to surface quality.

In an embodiment of the present invention, the concentrate can, for example, contain a hydrocolloid at a proportion of 0.1 to 10% by weight. The hydrocolloid can, for example, be selected from one of the substances agar agar, locust bean gum flour, pectin, gum arabic or starch or corn flour. These serve as release additives for an additional improvement of the lubricating effect, the releasing effect, the film forming and the wetting behavior. Likewise, polymers, such as polyethylene glycol or polyvinyl alcohol, can be mixed thereto for this purpose at a proportion of 0.1 to 10% by weight.

In an embodiment of the present invention, the concentrate can, for example, contain a preserving agent at a proportion of 0.1 to 5% by weight. This preserving agent can, for example, be potassium sorbate or ascorbic acid for the enhancement of the durability of the concentrate.

In an embodiment of the present invention, the concentrate can, for example, contain an ionic surfactant at a proportion of 0.1 to 5% by weight. Examples include sodium dodecyl sulfate or sodium lauryl sulfate. As an alternative or in addition, an organic or inorganic acid can be added to the concentrate at a proportion of 0.1 to 5% by weight. These are, for example, selected from the group including citric acid, lactic acid, formic acid, oxalic acid, phosphoric acid or para-toluene sulphonic acid. Theses additives enhance the wetting and washing behavior of the cooling and release agent or the lubricating agent and improve the cleaning properties of the agent.

In an embodiment of the present invention, the concentrate can, for example, contain anionic surfactants at a proportion of 0.1 to 5%. Examples of surfactants include anionic surfactants based on long-chain fatty acids, such as palm oil, linseed oil or bone fats, or also based on terpenes, such as limonene. These substances enhance the lubricating and releasing properties of the agent applied.

In an embodiment of the present invention, the concentrate can, for example, contain a softener at a proportion of 1 to 10% by weight, which softener can be a polyol, such as glycerin or sorbitol. These have a positive influence on the film formation and the washability of the cooling and release agent or the lubricating agent.

In an embodiment of the present invention, a fluxant at a proportion of 0.1 to 1% by weight can, for example, be mixed to the concentrate. An additional corrosion protection can thereby be achieved for the application. This fluxant can, for example, be a sodium borate or a lithium fluoride, lithium chloride or lithium carbonate.

In an embodiment of the present invention, the concentrate can, for example, contain a catalyst at a proportion of 100 to 500 ppm which can, for example, be an iron oxide or a ferric pyrophosphate or vanadium or its oxides or chrome or its oxides. This additive accelerates pyrolisis at lower temperatures.

In an embodiment of the present invention, a bactericide and a fungicide can, for example, be added at a proportion of, for example, 0.01 ppm to 1 ppm. Examples include silver salts, zinc salts or copper salts, for example, silver acetate, silver nitrate or silver chloride as bactericide.

In an embodiment of the present invention, solid lubricants, such as molybdenum disulphide or boron nitride, can, for example, be added at a proportion of 0.1 to 1% by weight.

A concentrate or a cooling and release agent or a lubricating agent is thus produced which, compared to the known agents, shows an enhanced cooling behavior while at the same time providing an improved releasing effect with a reproducible heat transfer behavior or an improved lubricating effect, respectively. Errors during the casting operation can thus be avoided and the dimensional accuracy of the cast parts can be maintained even for numerous cycles. When used as a lubricating agent in machining processes, the necessary cutting force is reduced.

The advantageous effects of this cooling and release agent were proven in tests which will hereinafter be described.

EXAMPLES

Example 1

In a first test, the concentrations for a cooling and release agent according to the present invention were determined at which a pyrolytic decomposition shows no adhesion of residues on the simulated cast part. The concentrate used was a solution with 50% by weight of gelatin having a molecular weight of 1000 to 7000 Dalton and with 16 to 19% by weight of nitrogen as a protein, 1% by weight of citric acid, 0.1 ppm of silver acetate as a bactericide, 0.1% by weight of potassium sorbate as a preserving agent and water for the rest.

A steel plate made from the material 1.2343 was first coated with a passivation layer having as its major components manganese phosphate and molybdenum sulphide. At a temperature of about 250° C., this steel plate was subsequently immersed for 10 seconds into a solution with a dry substance content of 0.25% which corresponds to a dilution ratio of the concentrate of about 1:200. A piece of aluminum made from the material $AlSi_9Cu_3$ was placed on the steel plate. After the film had dried, adhesion of the aluminum piece was found. The steel plate provided with the aluminum piece was thereafter placed for 1 minute into an oven heated to 750° C. in order to simulate the temperature stress during casting. After the sheet was removed, the aluminum piece could be moved very easily. Ash residues were found. It was shown that no tendency of release agent residues to adhere to the simulated cast part exists when a biodegradable release agent is used.

Example 2

In further tests on die casting tools, the concentration was further adapted to real conditions. For dry substance contents of 0.125%, which corresponds to a dilution ratio of the concentrate of about 1:400, a satisfactory demolding was obtained and no significant build-up of the cooling and release agent in the edge zones of the die or in the cavities could be found. Depending on the casting temperature, a complete pyrolytic decomposition was not always achieved one hundred percent.

Example 3

With dry substance contents of 0.0625%, which corresponds to a dilution ratio of the concentrate of 1:800, optimal cooling and release effects were obtained on the die casting tools. Compared to the use of the cooling and release agents known from prior art, an at least equal cooling effect was achieved while the proportions of the dry substance were reduced by up to 50%. The release effect observed was excellent. The optical quality of the surface was clearly enhanced when compared to the known cooling and release agents. The main reason for this property is the uniform wetting of the surface, since the cooling and release agent is a perfect solution and not merely an emulsion.

Example 4

In subsequent tests, the cooling/release agent with a dry substance content of 0.0625% was compared to a cooling and release agent according to the prior art. The reference cooling and release agent was an emulsion of polysiloxanes and synthetic polymers with a dry substance content of 0.15%.

Both products were used on a steel plate of the material 1.2343. The spray pressure during the wetting of the plate by means of a pressure atomizing spray head was about 1.5 bar.

The washing behavior of both cooling and release agents was first examined. Both products were sprayed as described above onto a steel plate heated to 200° C. A volume of 50 ml was applied, respectively. After cooling the respective films formed were wiped off with a cloth moistened with the corresponding cooling/release agent. The degree of cleaning was determined by dripping water thereon and by evaluating the wetting behavior. Here, the two plates treated with the cooling and release agents were compared.

The plate treated with the cooling and release agent showed a good wetting quality almost without flaws compared to the only mediocre wetting of the plate treated with the known cooling and release agent.

At the same time, a washing behavior was achieved that was enhanced to about the same extent, which thus is directly related to the wetting behavior.

When the steel surface was treated with the known agent, the surface was wetted only moderately, which is an indication of the presence of coatings with low surface tension, such as waxes or silicones, which have not been washed off. When the cooling and release agent of the invention was used, a good wetting of the surface was achieved which is due to the complete water solubility of the product of the invention.

The decomposition behavior of both cooling and release agents was checked on a steel plate made from the material 1.2343, wherein the steel plates were first heated for 5 minutes in an oven at a temperature of 500° C., and one of the products was applied to a respective plate in the manner described above. This process was repeated three times. 150 ml of the cooling and release agents were used per process.

For a determination of the remaining residues, the steel plate was wiped off with a white cloth after the final cooling. Compared to the plate sprayed with the known agent, the plate sprayed with the agent of the invention showed a clear reduction of the residues determined.

The tests performed proved that the use of the cooling and release agent of the present invention achieves both an improved wetting and an improved washability. As a result, better casting qualities can be obtained due to an enhanced decomposition behavior and to the resulting prevention of undesired layer build-up.

Example 5

In another test, the concentrate was mixed with water at a proportion of 1:50 for use as a cooling and lubricating agent.

The cooling and lubricating agent was used to cool an HSS drill bit of 7.5 mm in diameter. The drill bit was used to drill a hole into hot-working steel 1.2343 at 850 rpm. Compared to the conventional lubricating agents, it was found that the effort, i.e. the current consumption of the drill drive, decreased. Due to the improved cooling effect, a strong smoke production that had previously occurred, could be completely avoided as well as a bluish discoloring of the steel part and of the chips produced. The chips formed were long and uniform. No built-up edges could be found.

Depending on the temperature, the cooling and lubricating agent described is thus a shear resistant system. For increased drill powers, the cooling performance could be improved with respect to other agents, since the pressure resistant cooling and lubricating agent has an improved releasing effect.

The present invention is not restricted to the particular embodiments described herein, reference should also be made to the claims. Various modifications can also be made by an expert in the field without leaving the scope of protection of the claims.

What is claimed is:

1. An agent for reusable casting dies such as a steel casting die or for machining with an active substance dissolved in water, the agent comprising:

a concentrate comprising 10 to 50 wt.-% of a protein based on a weight of the concentrate, wherein, the concentrate is diluted in water at a ratio of from 1:20 to 1:1,200, the protein has a molecular weight of from 1,000 to 7,000 Dalton, and the protein is a hydrolysate.

2. The agent as recited in claim 1, wherein the protein has a nitrogen content of from 16 to 19% based on the weight of the protein.

3. The agent as recited in claim 1, wherein the concentrate further comprises a hydroxyproline content of from 10 to 15%.

4. The agent as recited in claim 1, wherein the concentrate further comprises from 0.1 to 10 wt.-% of a hydrocolloid or from 0.1 to 10 wt.-% of a polymer.

5. The agent as recited in claim 4, wherein the hydrocolloid is selected from at least one of an agar-agar, a locust bean gum flour, a pectin, a gum arabic, a starch, a corn flour, and the polymer is a polyethylene glycol or a polyvinyl alcohol.

6. The agent as recited in claim 1, wherein the concentrate further comprises from 0.1 to 5 wt.-% of a preserving agent.

7. The agent as recited in claim 6, wherein the preserving agent is potassium sorbate or ascorbic acid.

8. The agent as recited in claim 1, wherein the concentrate further comprises from 0.1 to 5 wt.-% of an ionic surfactant.

9. The agent as recited in claim 8, wherein the ionic surfactant is sodium dodecyl sulphate or sodium lauryl sulphate.

10. The agent as recited in claim 1, wherein the concentrate further comprises from 0.1 to 5 wt-% of an organic acid or an inorganic acid.

11. The agent as recited in claim 10, wherein the organic acid or the inorganic acid is at least one of a citric acid, a lactic acid, a formic acid, an oxalic acid, a phosphoric acid and a para-toluene sulphonic acid.

12. The agent as recited in claim 1, wherein the concentrate further comprises from 0.1 to 5 wt.-% of an anionic surfactant.

13. The agent as recited in claim 12, wherein the anionic surfactant is produced on the basis of at least one of long-chained fatty acids and terpenes.

14. The agent as recited in claim 1, wherein the concentrate further comprises from 1 to 10 wt.-% of a softener.

15. The agent as recited in claim 14, wherein the softener is a polyol.

16. The agent as recited in claim 15, wherein the polyol is glycerin or sorbitol.

17. The agent as recited in claim 1, wherein the concentrate further comprises from 0.1 to 1 wt.-% of a fluxant.

18. The agent as recited in claim 17, wherein the fluxant is a sodium borate, a lithium fluoride, a lithium chloride, or a lithium carbonate.

19. The agent as recited in claim 1, wherein the concentrate further comprises from 100 to 500 ppm of a catalyst.

20. The agent as recited in claim 19, wherein the catalyst is an iron oxide, a ferric pyrophosphate, vanadium, a vanadium oxide, chrome, or a chrome oxide.

21. The agent as recited in claim 1, wherein the concentrate further comprises from 0.01 to 1 ppm of a bactericide/fungicide.

22. The agent as recited claim 21, wherein the bactericide/fungicide is at least one of a silver salt, a zinc salt and a copper salt.

23. The agent as recited in claim 1, wherein the concentrate further comprises from 0.1 to 1 wt.-% of a solid lubricant.

24. The agent as recited in claim 23, wherein the solid lubricant is at least one of molybdenum disulphide and boron nitride.

25. The agent as recited in claim 1, wherein the concentrate is diluted in water at a ratio of from 1:100 to 1:1,200.

26. The agent as recited in claim 25, wherein the ratio is 1:500 to 1:1,000.

27. The agent as recited in claim 1, wherein the concentrate is diluted in water at a ratio of from 1:20 to 1:500.

* * * * *